US005617655A

United States Patent [19]

Launder et al.

[11] Patent Number: 5,617,655

[45] Date of Patent: Apr. 8, 1997

[54] SECUREMENT PIN FOR EARTH EXCAVATION TEETH

[75] Inventors: Richard L. Launder, Whittier, Calif.; Charles Clendenning, Broken Arrow, Okla.

[73] Assignee: H&L Tooth Company, Tulsa, Okla.

[21] Appl. No.: 454,490

[22] Filed: Mar. 22, 1995

[51] Int. Cl.[6] ..... E02F 9/28

[52] U.S. Cl. ..... 37/457; 37/455; 37/456; 403/355

[58] Field of Search ..... 37/455–458; 403/150, 403/153, 297, 355; 299/109, 111, 113

[56] References Cited

U.S. PATENT DOCUMENTS

| | | | |
|---|---|---|---|
| 2,483,032 | 9/1949 | Baer | 403/355 X |
| 2,762,139 | 9/1956 | Launder | 37/456 X |
| 2,951,300 | 9/1960 | Ratkowski | 37/457 |
| 2,994,141 | 8/1961 | Stephenson | 37/456 |
| 3,089,263 | 5/1963 | Henkel | 37/456 |
| 3,256,622 | 6/1966 | Hostetter | 37/458 |
| 3,275,376 | 9/1966 | Prox, Jr. | 299/109 |
| 3,494,245 | 2/1970 | Helton | 37/458 X |
| 3,572,785 | 3/1970 | Larson | 37/457 X |
| 4,155,665 | 5/1979 | Kaarela | 37/457 X |
| 4,282,665 | 8/1981 | Fletcher et al. | 299/109 X |
| 4,324,057 | 4/1982 | White | 37/457 |
| 4,338,736 | 7/1982 | Radigan | 370/458 |
| 4,516,340 | 5/1985 | Launder | 370/457 |
| 5,144,762 | 8/1992 | Robinson | 370/457 |
| 5,394,629 | 3/1995 | Ruvang et al. | 37/457 |

*Primary Examiner*—Randolph A. Reese
*Assistant Examiner*—Thomas A. Beach
*Attorney, Agent, or Firm*—Lyon & Lyon

[57] ABSTRACT

A pin assembly for securing large earth excavation teeth on the nose portions of their mounting adaptors attached to the shovel for excavating bucket of the excavating equipment. The pin assembly is comprised of an elongated steel bearing pin and a compressible flexpin adapted for mating engagement with and between the adaptor and the bearing pin. The bearing pin defines a convex bearing surface on the rearward side thereof for engaging portions of the excavation tooth and a concave bearing surface in the forward side thereof for mating engagement with a convex bearing surface defined by the rearward side of the flexpin. The flexpin further defines a convex bearing surface on the forward side thereof adapted to abut the channel wall of the mounting adaptor through which the pin extends and additionally defines a rearward projection on the rearwardly disposed convex bearing surface which extends into a recessed area formed in a central portion of the concave bearing surface on the bearing pin and thereby interlocks the flexpin to the bearing pin to prevent separation thereof during use. Rearwardly offset portions on the forward surface of the flexpin and rearward surface of the bearing pin define interlocking shoulders for engaging the pins with portions of the tooth and adaptor to secure the pin assembly therebetween and provide a tight securement of the excavation tooth on the adaptor.

12 Claims, 3 Drawing Sheets

SECUREMENT PIN FOR EARTH EXCAVATION TEETH

BACKGROUND OF THE INVENTION

The present invention relates to an improvement in the flexpins used for securing large earth excavation teeth to the nosepiece of the adaptor attached to the shovel or excavating bucket of the excavation equipment. The securement pins commonly used for such applications are ellipsoidal in cross section and comprise two elongate steel alloy members secured by a hard resilient rubber or silicone center. U.S. Pat. No. 4,516,340 describes such a pin and its use in detail. Briefly, each elongate member defines a beveled forward nose portion to facilitate insertion of the pin through the aligned orifices in the excavation tooth and the slightly offset channel in the adaptor and a flat heel portion to present a blunt surface to the hammer or other implement used to drive the pin into place. The central portions of the two elongate members are offset relative to the nose and heel portions to provide annular abutment shoulders for engaging portions of the excavation tooth and adaptor about the orifices and channel through which the pin extends to hold the pin in place during use and thereby secure the tooth to the adaptor. The generally elliptical or round opening through the tooth and adaptor which receives the pin defines a major axis somewhat less than the major axis of the securement pin so that the pin must be compressed about its resilient center as it is driven into place. Once in place the compressed center urges the two steel elongate member on either side thereof against the side walls of the tooth orifices and adaptor channel with sufficient strength to rigidly affix the tooth to the adaptor. The strength required of such pins to achieve this result, however, does create certain problems, particularly with respect to pin insertion and removal.

Because of the tremendous forces exerted on these pins during use, they must be extremely strong and durable. They must also provide a very tight securement between the tooth and adaptor as relative movement therebetween will tend to move the pin which fatigues the rubber center and causes premature product failure. While these securement pins vary in size depending on the size of the bucket and digging teeth with which they are used, they must often be quite large to have the necessary strength and provide the tight securement required for large excavation teeth. For example, a mounting adaptor can often weigh about 700 lbs. and carries excavation tooth weighing about 185 lbs. A typical securement pin for such an assembly is about 2.25×1.5 inches in cross section, 9.5 inches in length and weighs about 6 lbs. To install such pins in these assemblies under normal conditions requires two men and the use of a 16 lb. sledge hammer due to the necessary size of the pin, the compression required to effect insertion and the large surface areas thereon which bear tightly against the tooth and adaptor and collectively provide the strength and securement forces necessary to retain the tooth firmly in place during use. When these excavation teeth become worn and require replacement, the pin must be removed which again requires two men and is typically even a more difficult task as the pin also has become worn, deformed and has dirt and rock fines lodged between the pin and adjacent surfaces. Failure to meet tight tolerances in the manufacture of the tooth, adaptor or pin can make installation and removal even more difficult or result in inadequate tooth securement and product failure. In addition, the forces exerted on the pin during installation and removal by such a large hammer can fracture the heel of the pin, causing steel chips to fly therefrom and create a significant safety hazard for a nearby personnel.

Despite the size of these flexpins, the forces exerted thereon during use can be so large that they can bend the backside of the pin which is defined by the rearwardly disposed steel elongate member. When this occurs, the pin can be driven or "jacked" upwardly or downwardly from its securement position causing product failure. This typically occurs in difficult excavation applications employing hydraulic, backhoes and shovel designs wherein the forces are exerted on both the upper and lower surfaces of the excavation tooth. Because of the configurations of the mating component parts, such forces are relatively isolated and are transmitted directly to the backside of the upper and lower regions of the rear portion of the flex pin against which the tooth bears and, despite the solid steel construction of the rearwardly disposed elongate member, causes a bending thereof. As the upper and lower end portions of the rear elongate member on the flex pin are pushed forwardly, the pin looses it locking engagement on its backside with the excavation tooth, allowing the pin to be jacked upwardly or downwardly relative to the tooth and adaptor depending on the movement of the tooth through the earth, ultimately resulting in tooth loss or failure. Even when tooth loss does not occur, such bending of the pin during use, like the sheer forces exerted on the rubber center portion thereof during installation and removal, tends to deteriorate the rubber center of the pin. Deterioration of the rubber also results in a loss of locking power and can accelerate the tendency of the pin to jack out also during use.

The pin assembly of the present invention provides an economical solution to each of the aforesaid problems inherent in the securement flexpins employed in the attachment assemblies for large earth excavation teeth without sacrificing any of the benefits of such pins or requiring modification of either the teeth or mounting adaptors currently in use.

SUMMARY OF THE INVENTION

Briefly, the present is directed to a flexible pin assembly for securing large excavation teeth on large earth excavation equipment which is relatively easy to install and replace and provides a tight and durable securement between the tooth and mounting adaptor. The securement pin assembly of the present invention comprises a large elongate steel bearing pin and a compressible flexpin of substantially equal length but of smaller cross-sectional dimensions. The bearing pin is configured to be easily inserted through the rearward portions of the orifices in the excavation tooth and the slightly offset channel in the adaptor and be held therein by an outwardly and rearwardly projecting flange on the upper end of the pin. The flexpin is adapted to be forcibly driven through forward portions of said orifices and channel and compressed against and between the wall portions thereof and a concave bearing surface formed by an open channel in the forward wall of the bearing pin. As the flexpin is driven into place, the bearing pin continues to be held in place by the flange on the upper end thereof bearing against the upper surface of the base of the tooth about the orifice therein and the flexpin bears against and interlocks with both the adaptor and the bearing pin along opposite sides thereof and forces the bearing pin against and into an interlocking relationship with the tooth, thereby firmly securing the tooth to the adaptor.

To enable the pin assembly to be readily installed and removed, yet maintain sufficient bearing engagement with the excavation and adaptor such that the pin assembly would not be forced therefrom during use, the pin assembly is configured such that the holding strength is largely provided by the large rear bearing pin which, without the flexpin disposed thereagainst, is easily inserted into place within the tooth and adaptor. The flexible pin with its smaller bearing surfaces can then be far more easily driven into position against the larger bearing pin to effect bearing engagement of the larger surfaces thereon and a tight tooth securement.

The aforesaid configuration is achieved by forming the bearing pin so as to define a large convex bearing surface extending about and along the rear side thereof which has offset portions therein so as to define tooth abutment shoulders thereon as on the rearward side of a conventional flexpin. The forward side of the bearing pin has an open channel therein defining a smaller radius convex bearing surface adapted to abut and engage the smaller flexpin. The flexpin is comprised of a pair of elongate steel members joined by a hard compressible material wherein each member defines a convex bearing surface, a flat upper end and tapered forward end. The bearing surface defined by the rearwardly disposed elongate member is radiused so as to mate and bear against the concave bearing surface in the forward side of the bearing pin and defines a centrally disposed offset portion which projects into a recess formed in the concave bearing surface to interlock the flex and bearing pins to prevent axial separation thereof even if the larger bearing pin were bent under stress during use. The bearing surface defined by the forwardly disposed elongate member on the flexpin is sized so as to mate with and bear against the channel wall in the adaptor and defines forwardly offset upper and lower portions which extend over portions of the adaptor so as to prevent axial separation of the flexpin from the adaptor upon the flexpin being driven into position between the bearing pin and adaptor. Through the aforesaid mating and interlocking configurations, the pin assembly of the present invention can be readily inserted and removed yet will not be driven from the tooth and adaptor during use.

In the event the adaptor was to become sufficiently worn that the bearing pin could loose its interlock with the tooth during use as well as in extreme digging conditions where the forces acting against the upper end of the bearing pin are extremely large, the bearing pin still cannot be driven downwardly out of its securement position due to the outwardly and rearwardly projecting flange on the upper end thereof bearing against the adjacent upper surface of the tooth. In the preferred embodiment of the invention, a rearwardly projecting flange is additionally provided on the lower end of the bearing pin which will not interfere with the insertion of the bearing pin through the orifices in the tooth and aligned channel in the adaptor, but upon forcible insertion of the flexpin would prevent the bearing pin from being driven upwardly from its securement position in extreme conditions or in the event the adaptor were to become overly worn. As the flexpin is smaller in size than the bearing pin, the area forces acting thereon during use are not as great as the forces tending to dislodge the bearing pin and as the flexpin is firmly interlocked with the bearing pin, the flexpin will not be dislodged during use even in extreme conditions. As a result, a tight securement of the tooth to the adaptor is continually provided, It is the principal object of the present invention to provide an improved pin assembly for securing conventional large earth excavation teeth to the adaptors on which the teeth are mounted.

It is another object of the present invention to provide a pin assembly for securing earth excavation teeth to their mounting adaptors which is relatively easy to install and remove yet continually provides a tight securement of the tooth to the adaptor during use.

It is yet another object of the present invention to provide a pin assembly for securing large excavation teeth to their mounting adaptors which is highly resistant to being moved out of its locked position by the forces acting thereon during use.

it is still another object of the present invention to provide a pin assembly which provides increased locking strength over the flexpins heretofore in use.

It is a still further object of the present invention to provide a securement pin assembly for securing large earth excavation teeth to their mounting adaptors which is safer to install and remove than the pins heretofore in use.

These and other objects and advantages of the present invention will become readily apparent from the following detailed description taken in conjunction with the accompanying drawings.

FIG. *6a–d* are schematic representations illustrating the use of the securement pin assembly of the present invention.

Figure 7:
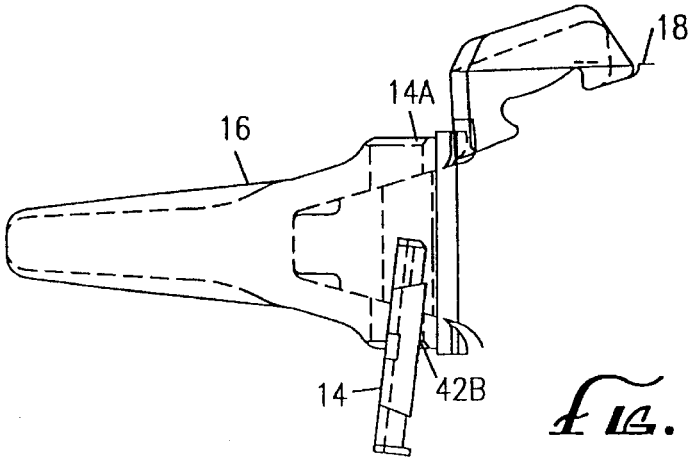

FIG. 7 is a side view illustrating an alternative mounting of the pin assembly of the present invention.

Figure 8:
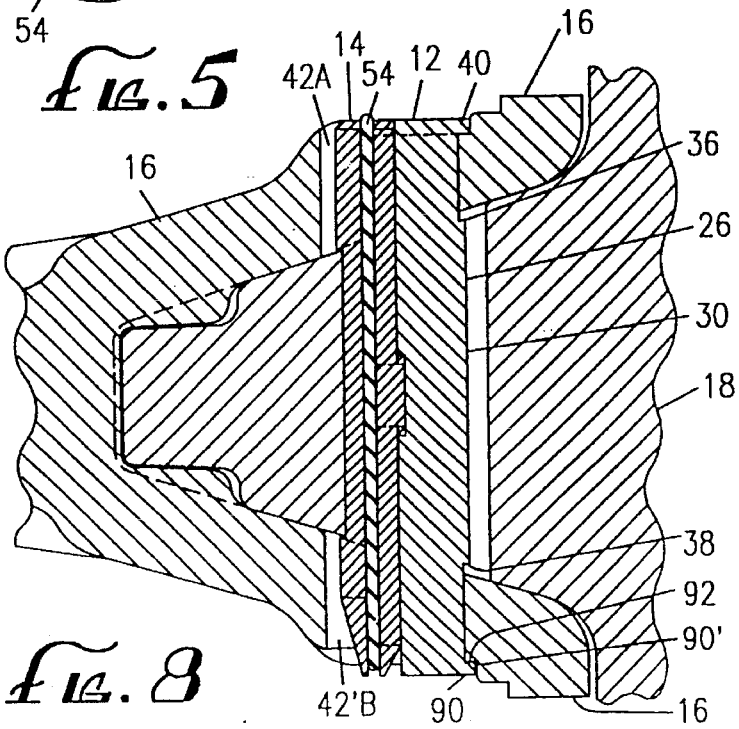

FIG. 8 is a sectional view of a pin assembly of the present invention employing a modified embodiment of the bearing pin and securing a large excavation tooth onto its mounting adaptor.

DESCRIPTION OF THE PREFERRED EMBODIMENT

The securement pin assembly 10 of the present invention comprises a bearing pin 12 and a flexpin 14 which cooperate to secure a conventional earth excavation tooth 16 on the standard adaptor 18 which is attached to the shovel or bucket of the earth excavation device (not shown). The bearing pin 12 is formed of heat treated alloy steel, preferably nickel bearing for ductility in cold weather, and defines a flat upper end 20, a beveled lower end 22, flat side wall portions 24, a large constant radius convex bearing surface 26 extending along the rearward end thereof and a smaller, semi-circular, constant radius, concave bearing surface 28 extending along the forward end thereof. The convex bearing surface 26 has an elongated centrally disposed portion 30 which is rearwardly offset from portions 32 and 34 adjacent the upper and lower end 20 and 22 of the pin so as to define tooth abutment shoulders 36 and 38. The concave bearing surface 28 has a recessed area 29 centrally disposed therein defining flexpin abutment shoulders 31 and 33. A laterally and rearwardly extending flange 40 is formed adjacent the flat upper end 20 of bearing pin 12 such that when the bearing pin 12 is inserted into position through the aligned orifices 42*a* and 42*b* in tooth 16 and vertical channel 44 in the adaptor 18, the outwardly projecting flange 40 will rest against a flat recessed horizontal surface 46 in the upper end of the base of tooth 16 adjacent orifice 42*a* to hold the bearing pin 12 in place while the flexpin 14 is driven into position.

Figure 2:
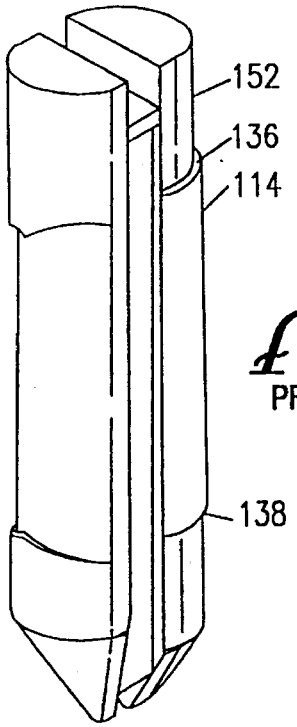
FIG. 2 PRIOR ART
FIG. 2 is a perspective view of a flexpin of the type heretofore in use.
Figure 3:
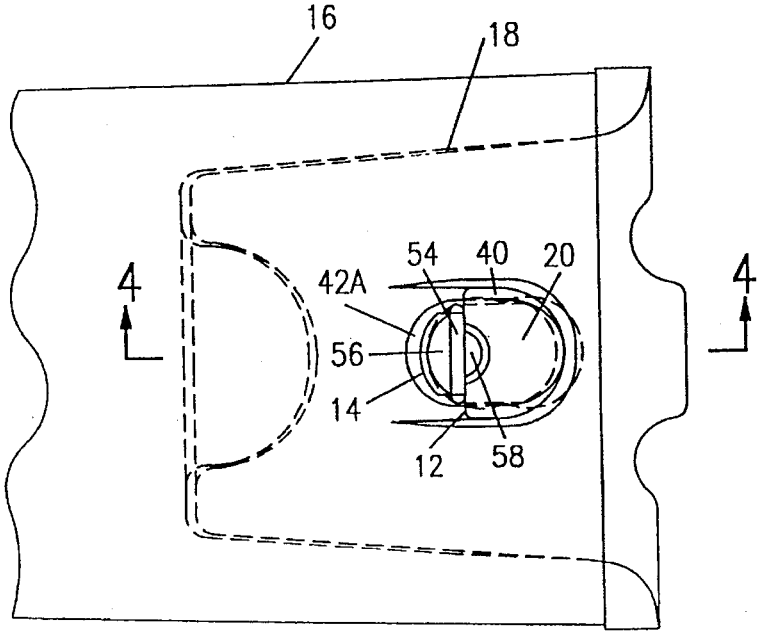
FIG. 3 is a top plan view of an excavation tooth secured to its mounting adaptor by a flexpin assembly of the present invention.

The flexpin 14 employed in assembly 10 is similar in configuration to a conventional flexpin 14', shown in FIG. 2, but is smaller and particularly configured to cooperate with bearing pin 12 in the securement tooth 16 to adaptor 18. Flexpin 14 comprises a forward elongate member 50, a rear elongate member 52 and a hard resilient rubber or silicone center 54 secured thereto and extending therebetween. The elongate members 50 and 52 in flexpin 14 are preferably formed of a nickel bearing alloy steel and each respectively defines flat upper ends 56 and 58 and tapered lower ends 60 and 62. Center 54 is vulcanized or cured to the flat inner surfaces of 50' and 52' of elongate members 50 and 52 so as not to separate therefrom. If desired, a wave spring or a plurality of coils springs can be encapsulated within resilient center 54 such that they extend between elongate members 50 and 52. It has been found that the addition of such spring(s) is desirable in applications where the excavation teeth have a particularly long life so that the pin assemblies are not frequently changed and as a result, the resilient pin centers will begin to fret. The addition of the embedded spring(s) will prolong the life of the pin assembly in such instances. A wave spring or plurality of equidistantly spaced coil springs are provided during fabrication of the flexpin 14 by simply providing recesses in the interior faces of elongate members 50 and/or 52 as needed to support the ends of the spring or springs, whereupon the rubber or silicone center is formed about the spring(s) and vulcanized or cured, encapsulating the spring(s) in place.

Figure 4:
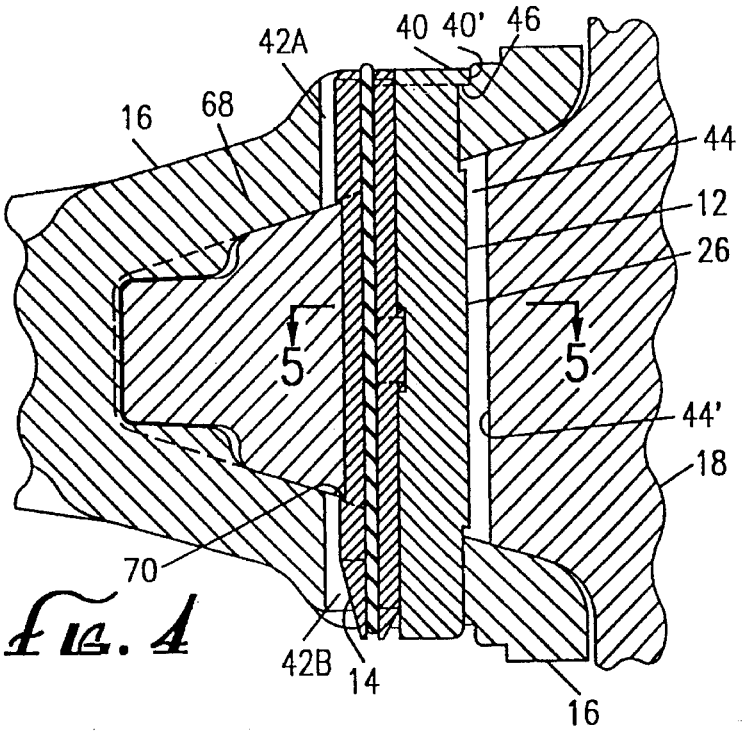
FIG. 4 is a sectional view of the flexpin assembly securing a large excavation tooth onto its mounting adaptor.
Figure 5:
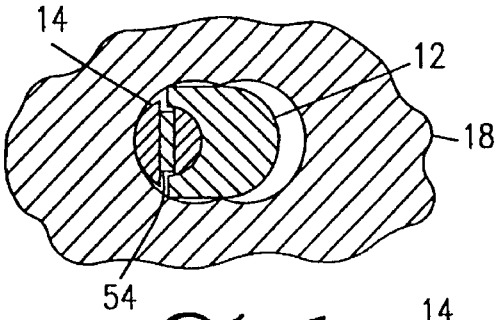
FIG 5 is a cross-sectional view taken along the line 5—5 in FIG. 4.

The forward elongate member 50 of flexpin 14 defines a convex bearing surface 64 extending along the forwardly facing side thereof. Bearing surface 64 has a rearwardly offset elongated central portion 66 defining adaptor engaging shoulders 68 and 70 between central portion 66 and the upper and lower end portions 72 and 74 of bearing surface 64. Portions 66, 72 and 74 of bearing surface 64 are all radiused so as to mate with the forward wall portions of orifices 42*a* and 42*b* in the excavation tooth and the forward wall portion of channel 44 in the adaptor. The rear elongate member 52 of flexpin 14 also defines a convex bearing surface 76 which is radiused so as abut and mate the concave bearing surface 28 in the forward wall of bearing pin 12. As seen in FIG. 5, the radius of bearing surface 64 on the forward end of flexpin 14 is substantially less than the radius defined by rear bearing surface 26 on bearing pin 12 and is substantially greater than the radius defining concave bearing surface 28 in bearing pin 12 and the bearing surface 76 on flexpin 14. To provide an interlock between the flexpin 14 and the bearing pin 12, the rearward bearing surface 76 on flexpin 14 defines a rearwardly projecting portion 78. The projecting portion 78 is preferably centrally disposed on bearing surface 76 and is adapted to be received in the recessed area 29 formed in concave bearing surface 28 of bearing pin 12 upon the flexpin being driven into position as seen in FIG. 4. In this position, projecting portion 78 is held within recessed area 29 and the shoulders 31 and 33 defined by recessed area 29 prevent relative axial movement between the flexpin 14 and bearing pin 12 sufficient to disengage the pin assembly 10 from its locked position between tooth 16 and adaptor 18.

Figure 6A:
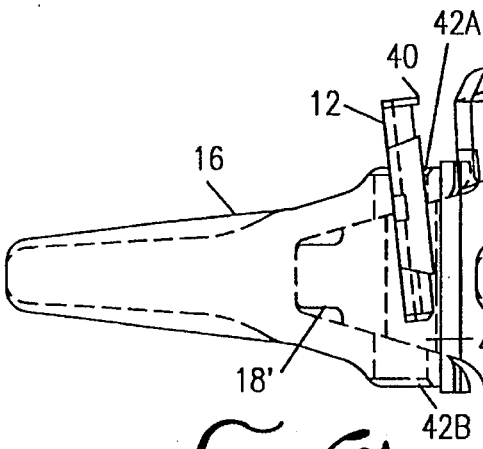
Figure 6B:
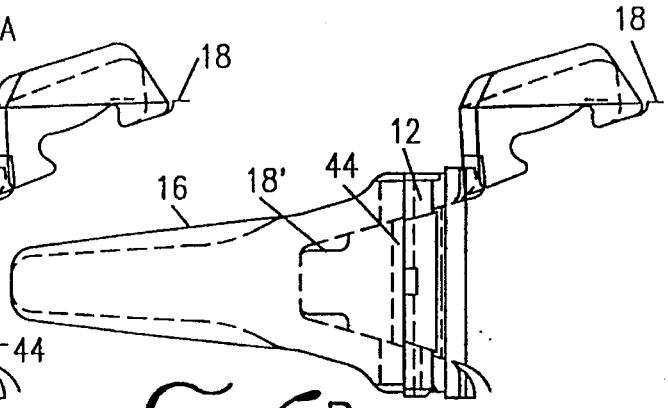

The installation of pin assembly 10 to secure tooth 16 on adaptor 18 is illustrated in FIGS. 6*a*–6*d*. As seen therein, the tooth 16 is first disposed over the nose portion 18' of adaptor 18 such that the orifices 42*a* and 42*b* in the upper and lower surfaces of the rear portion of the tooth are substantially aligned with the channel 44 in the adaptor. As seen in FIG. 4, orifices 42*a* and 42*b* are offset slightly from channel 44 to provide engagement surfaces for the abutment shoulders formed on the bearing and flexpins. To secure tooth 16 on adaptor 18, the bearing pin 12 is first inserted through the aligned orifices and channels as shown in FIG. 6*a*. Bearing pin 12 is configured so as to slide easily into place. Upon being fully inserted, the lateral flanges 40 on the upper end of bear pin 12 will rest against recessed horizontal surface 46 formed in the upper end of the tooth 16 adjacent orifice 42*a*. In this position, illustrated in FIG. 4, the upper and lower portions 32 and 34 of rear bearing surface 26 on pin 12 are disposed adjacent the rear wall portions of orifices 42*a* and 42*b* in tooth 14 and the central rearwardly projecting portion 30 of bearing surface 26 is spaced slightly forwardly of the rear wall portion 44' of channel 44 in the mounting adaptor 18. The concave bearing surface 28 in bearing pin 12 projects forwardly.

Figure 6C:
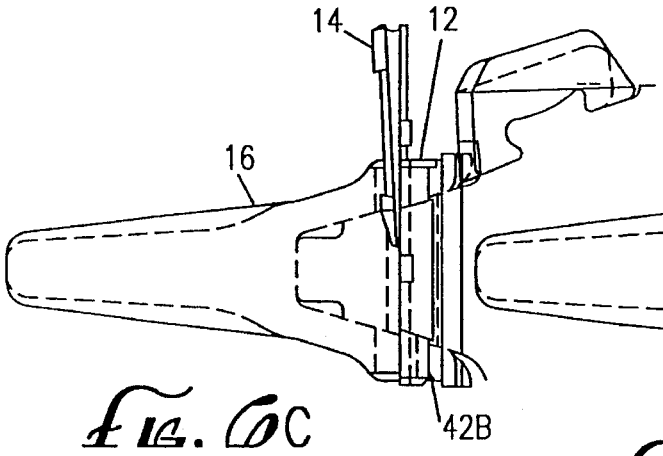

With bearing pin 12 in place, the tapered lower end of flexpin 14 is inserted between the upper end of bearing pin 12 and the forward wall portion of tooth orifice 42*a* and pushed downwardly to the position illustrated in FIG. 6*c*. In this position, the lower portion of the rearwardly disposed convex bearing surface 76 of flexpin 14 is adjacent the upper portion of the concave bearing surface 28 in the bearing pin 12 while the tapered lower end 60 of forward elongate member 50 of flexpin 14 extends into the upper portion of channel 44 in adaptor 18 and abuts the upper wall portion thereof as seen in FIG. 6*c*. In this position, the flexpin 14 can be driven to the lower locked position using only a 4 lb. hammer without danger of chipping the upper end of the flexpin as can typically occur when the conventional flexpin shown in FIG. 2 is driven into position by a 20 lb. sledge hammer.

Figure 6D:
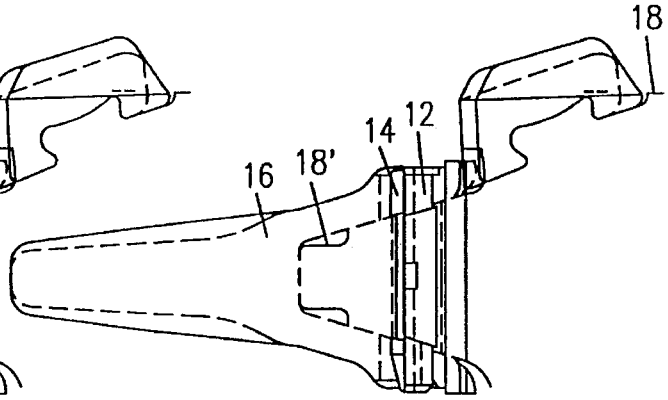

As the flexpin 14 is forced downwardly into the position shown in FIGS. 6*d* and 4, the flexpin is compressed about its resilient center 54 to allow for such insertion. In the locked position, the rearwardly projecting portion 78 on rear bearing surface 76 extends into recessed area 29 in bearing surface 28, preventing relative axial movement between flexpin 14 and bearing pin 12 as earlier described. Shoulders 68 and 70 on the forward bearing surface 64 of flexpin 14 are disposed about portions on adaptor 18 adjacent the upper and lower ends of channel 44 therein. Locking shoulders 36 and 38 on the rear side of bearing pin 12 are conversely disposed between portions of tooth 16 adjacent the inner ends of orifices 42*a* and 42*b* therein and the compressed center 54 of the flexpin continually urges the central portion 66 of the forward bearing surface 64 on flexpin 14 against the forward wall portion of channel 44 in mounting adaptor 18 and the upper and lower portions 32 and 34 of convex bearing surface 26 on the rearward side of bearing pin 12 against the rearward wall portions of orifices 42a and 42*b* in tooth 16, thereby holding pin assembly 10 firmly in place and tooth 16 securely on adaptor 18.

To remove the pin assembly 10 for replacement of the excavation tooth 16, a cylindrical tool (not shown) is held against the flat upper ends 56 and 58 of the steel elongate members in the flexpin 14, whereupon a 4 lb. hammer can be used to strike the tool and drive the flexpin downwardly and out of engagement with the channel wall in the adaptor 18 and the concave bearing surface 28 in the bearing pin 12. In contrast, removal of a conventional flexpin such as that shown in FIG. 2, requires two men and a use of a 16 lb.

sledge hammer due to the larger bearing surfaces thereon which are held against the tooth and adaptor by the resilient center as well as the larger abutment shoulders which must be driven past abutting adjacent portions of the tooth and adaptor.

In addition to being difficult to install and remove, the flexpin 114 of the prior art tends to bend rearwardly during use due to the large forwardly directed forces exerted against the rear side of the pin proximate the upper and lower ends thereof where the pin is engaged by the rearward wall portions of the orifices 42*a* and 42*b* in the excavation tooth. As a result, the interlock of shoulders 136 and 138 formed on the rearward side of flexpin 114 with the portions of the excavation tooth adjacent the inner rearward ends of orifices 42*a* and 42*b* is lost. Without such an interlock, the flexpin 114 can be jacked out of engagement with the tooth and adaptor as noted earlier herein.

Figure 1:
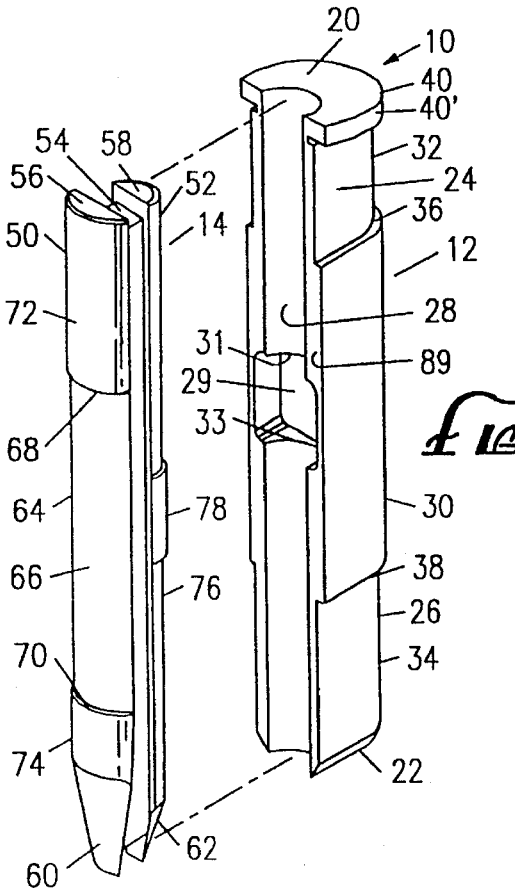
FIG. 1 is an exploded perspective view of the two components of the securement pin assembly of the present invention.

With the assembly 10 of the present invention the flange 40 at the upper end of the bearing pin 12 prevents the bearing pin from being jacked downwardly even if the adaptor 18 were to become so worn that the tooth 16 moved rearwardly thereover a sufficient distance that the interlock between bearing pin 12 and tooth 16 were lost. Flange 40 also prevents any downward movement of the bearing pin during use even in the most severe applications where the pressure exerted on the large upper end of pin 12 would be so great that it might otherwise dislodge the pin despite the engagement of the intermediary portions of the pin 12 with the flexpin 14 and excavation tooth 16. While not apparent from the drawings, bearing pin 12 is significantly larger in its transverse dimensions than the rearwardly disposed elongate member 152 of a conventional prior art flexpin 114 (see FIG. 2). By way of example, a representative transverse dimension across a bearing pin 12 is 1½ inches vs. 1⅜ inches for a comparable conventional flexpin 114 and the thickness of the bearing pin as measured from its forward most edge 89 (see FIG. 1) to the rearward end of the central portion 30 of bearing surface 26 is 1⅝ inches. The rearward elongate member 152 of a comparably sized conventional flexpin 114 is only 1 inch thick. The larger size of bearing pin 12 and the bearing contact between and along the lengths of the flexpin 14 and bearing pin 12 combine to inhibit bending of bearing pin 12 and the loss of the rear lock between the assembly and excavation tooth. It should be noted that the interlock between flexpin 14 and bearing pin 12 is provided at the mid points of the two pins. Thus, even if pin 12 were to bend during very extreme conditions, there would be virtually no bending at the central location where the flexpin 14 interlocks with bearing pin 12. Such a configuration thus provides an additional securement for the pin assembly and further reduces the chance of any upward pin slippage during use.

In the event some upward slippage of the bearing pin 12 were to occur due to severe pressure being exerted over the bottom of the tooth either in excessively severe digging conditions or in instances where the adaptor has become overly worn, the bearing pin. 12 could be installed from the bottom while the flexpin 14 is still driven into position from the top. In such a case, the lateral flanges 40 on the bearing pin would prevent such an upward jacking movement. This reversal of the bearing pin is possible due to the symmetry of the bearing pin and the engagement surfaces thereon. More preferably, however, a second flange 90 could be formed on the lower end of the bearing pin. Such a modification of bearing pin 12 is illustrated in FIG. 8. Flange 90 differs from upper flange 40 in that the flange 90 projects only rearwardly and not both rearwardly and laterally as does flange 40. By projecting only rearwardly, flange 90 will not interfere with the insertion of the bearing pin through the aligned orifices 42*a* and 42*b* and channel 44 in the tooth 16 and adaptor 18 respectively. However, upon the flexpin 14 being subsequently driven into place, flange 90 will project rearwardly over a flat lower surface 92 in the base of the tooth adjacent orifice 42*b* therein. So disposed, flange 90 prevents bearing pin 12 from being forced upwardly from its secured position under any circumstances just as flange 40 prevents the bearing pin from being forced downwardly.

The upper and lower retention flanges 40 and 90 are shown in the drawings as having vertical rear wall surfaces 40' an 90' respectively which are accommodated by the recessed areas in the base of tooth 16 rearwardly adjacent orifices 42*a* and 42*b* therein. However, in the excavation teeth currently in use there may not be sufficient space rearwardly of orifices 42*a* and 42*b* to accommodate such a straight wall flange configuration. In such instances the rear surfaces 40' and 90' of flanges 40 and 90 could be formed with an outward taper to conform to the geometry of the tooth and avoid the need for any modifications of the tooth to accommodate pin assembly 10. Various other changes and modifications can be made in carrying out the present invention without departing from the spirit and scope thereof. Insofar as these changes and modifications are within the purview of the appended claims, they are to be considered part of the present invention.

We claim:

1. A pin assembly for securing an earth excavation tooth on the nosepiece of a mounting adaptor by extending in a flexed disposition through substantially aligned openings in the tooth and adaptor and bearing against portions thereof, said assembly comprising an elongated rigid bearing pin and a compressible flexpin adapted for mating engagement with the adaptor and said bearing pin, said bearing pin defining a forwardly disposed elongated concave bearing surface and a rearwardly disposed elongated convex bearing surface, said flexpin including a first elongate member defining a forwardly disposed elongated convex bearing surface and a second elongate member defining a rearwardly disposed elongated convex bearing surface and including a compressible material disposed between and secured to said elongate members, said convex bearing surface on said bearing pin being substantially larger than both said concave bearing surface thereon and said convex bearing surfaces on said flexpin, said forwardly disposed bearing surface on said flexpin being adapted to abut and mate with portions of the mounting adaptor and said rearwardly disposed bearing surface on said flexpin being adapted to abut and mate with said concave bearing surface on said bearing pin whereby upon said bearing pin being inserted through the substantially aligned openings in the tooth and mounting adaptor and said flexpin being driven therethrough adjacent said bearing pin, said flexpin is maintained in a compressed disposition adjacent said concave surface of said bearing pin, urging said convex bearing surface on said bearing pin and said forwardly disposed bearing surface on said flexpin in opposed directions against portions of the tooth and the adaptor and securing the tooth on the adaptor.

2. The pin assembly of claim 1 wherein upon said flexpin being driven into a position adjacent said bearing pin, an intermediate portion of said rearwardly disposed bearing surface on said flexpin defines a locking engagement with a portion of said bearing pin adjacent said concave bearing surface thereon for preventing axial separation of said flexpin and said bearing pin.

3. The pin assembly of claim 1 wherein said bearing pin defines a recess therein adjacent said concave bearing surface and wherein said flexpin defines a rearwardly extending projection adapted to be received within said recess in said bearing pin upon said flexpin being driven into a position adjacent said bearing pin for interlocking said flexpin and said bearing pin to prevent axial separation thereof.

4. The pin assembly of claim 1 wherein said bearing pin defines a tooth engagement flange projecting outwardly from an upper end portion thereof for holding said bearing pin in place as said flexpin is driven into adjacent disposition with said bearing pin and preventing said bearing pin from being driven downwardly with respect to the tooth and adaptor during use.

5. The pin assembly of claim 4 wherein said tooth engagement flange extends laterally and rearwardly from said upper end portion of said bearing pin and including a second tooth engagement flange on said bearing pin, said second tooth engagement flange extending rearwardly from a lower portion of said bearing pin and preventing said bearing pin from being driven upwardly with the respect to the tooth and adaptor during use.

6. A pin assembly for securing an earth excavation tooth on the nosepiece of a mounting adaptor by extending in a flexed disposition through substantially aligned openings in the tooth and adaptor and bearing against portions thereof, said assembly comprising an elongated rigid bearing pin and a compressible flexpin adapted for mating engagement with the adaptor and said bearing pin, said bearing pin defining a forwardly disposed elongated concave bearing surface, a recessed area centrally disposed along said bearing surface, a rearwardly disposed elongated convex bearing surface, said convex bearing surface being substantially larger than said concave bearing surface, an intermediary portion of said convex bearing surface being rearwardly offset from upper and lower portions of said bearing surface so as to define tooth engagement shoulders between said upper and lower portions and said offset portion, and a tooth engagement flange projecting outwardly from an upper end portion of said bearing pin, said flexpin defining a forward elongate member, a rearward elongate member and a compressible member disposed between said forward and rearward members, said forward member defining a first convex bearing surface thereon, an intermediary portion of said first convex bearing surface being rearwardly offset from upper and lower portions of said bearing surface, said rearward elongate member defining a second convex bearing surface thereon adapted to abut and mate with said concave bearing surface on said bearing pin, said second convex bearing surface being substantially equal in size to said concave bearing surface, and a rearwardly extending projection disposed adjacent said second bearing surface and being adapted to be received within said recessed area along said bearing pin upon said flexpin being driven through the openings in the tooth and adaptor adjacent said bearing pin for interlocking said flexpin with said bearing pin.

7. The pin assembly of claim 6 wherein said flexpin defines an upper end and a lower ends and said rearwardly extending projection on said rearward elongate member defines an upper engagement shoulder and a lower engagement shoulder, said shoulders being adapted to abut portions of said bearing pin within said recessed area therein to interlock said flexpin with said bearing pin and wherein said upper shoulder is spaced a distance from said upper end of said flexpin substantially equal to the distance between said lower shoulder and said lower end of said flexpin.

8. The pin assembly of claim 6 wherein said tooth engagement flange extends laterally and rearwardly from said upper end portion of said bearing pin and including a second tooth engagement flange on said bearing pin, said second tooth engagement flange extending rearwardly from a lower portion of said bearing pin and preventing said bearing pin from being driven upwardly with the respect to the tooth and adaptor during use.

9. A pin assembly for securing an earth excavation tooth on the nosepiece of a mounting adaptor by extending in a flexed disposition through substantially aligned openings in the tooth and adaptor and bearing against portions thereof, said assembly comprising an elongated rigid bearing pin and a compressible flexpin adapted for mating engagement with the adaptor and said bearing pin, said bearing pin defining a forwardly disposed elongated concave bearing surface and a rearwardly disposed elongated convex bearing surface, said convex bearing surface being substantially larger than said concave bearing surface, said flexpin defining a forwardly disposed elongated convex bearing surface and a rearwardly disposed elongated convex bearing surface and including a compressible material disposed therebetween, said forwardly disposed bearing surface on said flexpin being adapted to abut and mate with portions of the mounting adaptor and said rearwardly disposed bearing surface on said flexpin being adapted to abut and mate with said concave bearing surface on said bearing pin whereby upon said bearing pin being inserted through the substantially aligned openings in the tooth and mounting adaptor and said flexpin being driven therethrough adjacent said bearing pin, said flexpin is maintained in a compressed disposition adjacent said concave surface of said bearing pin, urging said convex bearing surface on said bearing pin and said forwardly disposed bearing surface on said flexpin in opposed directions against portions of the tooth and the adaptor and securing the tooth on the adaptor.

10. The pin assembly of claim 9 wherein said bearing pin defines a recess therein adjacent said concave bearing surface and wherein said flexpin defines a rearwardly extending projection adapted to be received within said recess in said bearing pin upon said flexpin being driven into a position adjacent said bearing pin for interlocking said flexpin and said bearing pin to prevent axial separation thereof.

11. A pin assembly for securing an earth excavation tooth on the nosepiece of a mounting adaptor by extending in a flexed disposition through substantially aligned openings in the tooth and adaptor and bearing against portions thereof, said assembly comprising an elongated rigid bearing pin and a compressible flexpin adapted for mating engagement with the adaptor and said bearing pin, said bearing pin defining a forwardly disposed elongated concave bearing surface and a rearwardly disposed elongated convex bearing surface, said convex bearing surface being substantially larger than said concave bearing surface, said flexpin including a first elongate member defining a forwardly disposed elongated convex bearing surface and a second elongate member defining a rearwardly disposed elongated convex bearing surface and including a compressible material disposed between and secured to said elongate members, said forwardly disposed bearing surface on said flexpin being smaller than said rearwardly disposed bearing surface on said bearing pin and being adapted to abut and mate with portions of the mounting adaptor, said rearwardly disposed bearing surface on said flexpin being substantially equal in size to said concave bearing surface on said bearing pin and being adapted to abut and mate with said concave bearing surface, and a tooth engaging flange carried by and projecting from an end portion of said bearing pin whereby upon said bearing pin being inserted through the substantially aligned openings in the tooth and mounting adaptor and held by said flange as said flexpin is driven through said openings adjacent said bearing pin, said flexpin is maintained in a compressed disposition adjacent said concave surface of said bearing pin, urging said convex bearing surface on said bearing pin and said forwardly disposed bearing surface on said flexpin in opposed directions against portions of the tooth and the adaptor and securing the tooth on the adaptor.

12. A pin assembly for securing an earth excavation tooth on the nosepiece of a mounting adaptor by extending in a flexed disposition through substantially aligned openings in the tooth and adaptor and bearing against portions thereof, said assembly comprising an elongated rigid bearing pin and a compressible flexpin adapted for mating engagement with the adaptor and said bearing pin, said bearing pin defining a forwardly disposed elongated concave bearing surface and a rearwardly disposed elongated convex bearing surface, said concave bearing surface defining a first engagement means therein, said convex bearing surface being substantially larger than said concave bearing surface, said flexpin including a first elongate member defining a forwardly disposed elongated convex bearing surface and a second elongate member defining a rearwardly disposed elongated convex bearing surface and including a compressible material disposed between and secured to said elongate members, said forwardly disposed bearing surface on said flexpin being smaller than said rearwardly disposed bearing surface on said bearing pin and being adapted to abut and mate with portions of the mounting adaptor, said rearwardly disposed bearing surface on said flexpin being substantially equal in size to said concave bearing surface on said bearing pin and being adapted to abut and mate with said concave bearing surface, and defining a second engagement means thereon, whereby upon said bearing pin, inserted through the substantially aligned openings in the tooth and mounting adaptor and said flexpin being driven therethrough adjacent said bearing pin, said flexpin is maintained in a compressed disposition adjacent said concave surface of said bearing pin, urging said convex bearing surface on said bearing pin and said forwardly disposed bearing surface on said flexpin in opposed directions against portions of the tooth and the adaptor and causing said first and second engagement means to form an interlock between said bearing pin and flexpin, securing the tooth on the adaptor.

* * * * *